US005186636A

United States Patent [19]

Boyer et al.

[11] Patent Number: 5,186,636

[45] Date of Patent: Feb. 16, 1993

[54] ELECTRIC PLUG LOCK

[76] Inventors: David J. Boyer, 3528 Sassafras St., Erie, Pa. 16508; Rodney J. Cottrell, 606 Brown Ave., Erie, Pa. 16502

[21] Appl. No.: 858,659

[22] Filed: Mar. 27, 1992

[51] Int. Cl.[5] ..... H01R 13/44

[52] U.S. Cl. ..... 439/133; 439/134; 439/304; 439/367

[58] Field of Search ..... 439/133, 134, 304, 306, 439/308, 313, 320, 321, 333, 335, 367, 372, 680, 892

[56] References Cited

U.S. PATENT DOCUMENTS

| | | | |
|---|---|---|---|
| 2,643,787 | 6/1953 | Rockman | 439/133 |
| 4,407,554 | 10/1983 | Drall | 339/37 |
| 4,413,488 | 11/1983 | Harmisson, Jr. | 70/57 |
| 4,445,738 | 5/1984 | Wiencke | 339/37 |
| 4,488,764 | 12/1984 | Pfenning et al. | 339/37 |
| 4,640,107 | 2/1987 | Slade | 70/57 |
| 4,647,735 | 3/1987 | Sicher | 200/43.08 |
| 4,653,824 | 3/1987 | Jason et al. | 339/37 |
| 4,673,230 | 6/1987 | Baumgart | 439/133 |
| 4,674,813 | 6/1987 | Feldner | 439/133 |
| 4,679,873 | 7/1987 | Brackett, Jr. | 439/134 |
| 4,705,335 | 11/1987 | Gobel | 439/133 |
| 4,721,475 | 1/1988 | Burke, Jr. | 439/133 |
| 4,782,971 | 11/1988 | Hill | 220/3.2 |
| 4,812,131 | 3/1989 | Sieverman | 439/134 |
| 4,846,708 | 7/1989 | Marson et al. | 439/133 |
| 4,853,960 | 8/1989 | Smith | 379/437 |
| 4,865,557 | 9/1989 | Kershaw | 439/133 |
| 4,957,445 | 9/1990 | Burke, Jr. | 439/134 |
| 5,055,057 | 10/1991 | Boyer | 439/134 |
| 5,061,194 | 10/1981 | Herman et al. | 439/133 |
| 5,073,122 | 12/1991 | Burke, Jr. | 439/304 |

*Primary Examiner*—Paula A. Bradley
*Attorney, Agent, or Firm*—Charles L. Lovercheck; Wayne L. Lovercheck

[57] ABSTRACT

An electrical plug lock having a hollow body closed at one end and open at the other end. A closure having a fastening means for holding the closure in the body. The closure has a radially extending slot. A hole is formed in one side of the body to receive the hasp of a lock. When the slot is aligned with the hole in the body and the hasp is in the hole and in the slot the closure cannot be rotated. An electrical plug can be located inside the body and a cord on the plug can extend through the slot in the closure. The hasp of the padlock prevents the closure from being rotated to release the closure from the body.

7 Claims, 1 Drawing Sheet

ELECTRIC PLUG LOCK

BACKGROUND OF THE INVENTION

This invention relates, in general, to portable security devices for preventing the unauthorized use of an electrically operated appliance or devices for receiving an electrical cord and attached plug.

Various devices have been proposed for preventing the unauthorized use of an electrical cord and attached plug. These devices can be categorized in five groups: key locked electrical switches, key locked electrical plugs, locking cover assemblies for electrical wall receptacles, and key locked electrical receptacles for appliance cord plugs and key locked devices for enclosing part or all of an appliance cord plug.

The electrical switch devices of the first group have the disadvantage of requiring initial fabrication as part of the appliance cord or severing of the appliance cord and subsequent installation. Such installation of the key lock switch generates increased labor costs and requires additional time compared with other devices that do not require connection directly to the appliance cord.

The devices of the second group possess the disadvantage of replacing the original plug with which the appliance was manufactured. The substitution of plugs creates increased costs, installation time, and inconvenience that would not otherwise be incurred.

The devices of the third group suffer the disadvantage of being associated with a particular stationary electrical wall receptacle and of thereby not being readily portable with one particular appliance. In addition, these inventions cannot be relied on, or carried with, a particular electrical appliance's plug or cord when the appliance is not being used. Therefore, such security devices, if designed to be otherwise separately portable, are very susceptible to loss or misplacement during transport of the particular electrical appliance.

The apparatus of the fourth group have the disadvantage of being cumbersome, somewhat complex, and relatively more costly as they include an electrical receptacle within a security container. Further, these devices are not as conveniently portable as may be desired owing to their typically larger mass and bulk.

The devices disclosed by the patents of the fifth group all have the disadvantage of lacking the capability to be retained on the cord or plug of the electrical appliance when the device is not being used to prevent the unauthorized use of the appliance. Therefore, such devices can be more easily lost or misplaced when the appliance is in use and the device is not performing its designated function.

Until the present invention, the various disadvantages associated with the above-discussed types of security devices tended to make the use of such devices less convenient than desired and tended to inhibit the wide spread use of such devices.

There is a need for an improved security device that would not have to be electrically connected to the cord or plug of the appliance. Elimination of such an installation requirement would reduce the time necessary to use the device and eliminate inconvenience associated with such installations in general.

It would also be desirable with such an improved portable security container to provide a means for attaching the container to the cord or plug of the electrical appliance, to ensure against the loss or misplacement of the container during use or non-use of the appliance.

Applicant is aware of the following U.S. Pat. Nos.:

4,407,554 to Drall which shows an electrical plug safety device.

4,413,488 to Harmison, Jr. which shows an electrical appliance lock.

4,445,738 to Wiencke which shows a locking device for electrical plugs.

4,488,764 to Pfenning et al. which shows a portable security container for an electrical cord and attached plug.

4,640,107 to Slade which shows a safety lock apparatus for an electrical plug.

4,647,735 to Sicher for an electrical security device.

4,653,824 to Jason et al. which shows a lock-out device for electrical appliances.

4,673,230 to Baumgart which shows a security device for electrical plugs.

4,674,813 to Feldner for an electrical lock.

4,705,335 to Goebel which shows a plug safe.

4,721,475 to Burke, Jr. which shows a safety shroud for an electrical connector.

4,782,971 to Hill which shows a device for preventing the unauthorized use of an electrical apparatus.

4,812,131 to Sieverman which shows an electrical plug lock apparatus.

4,846,708 to Marson et al. which shows a jack security device.

4,853,960 to Smith which shows a station interface and protector apparatus.

4,865,557 to Kershaw which shows a security device for electric appliances.

4,957,445 to Burke, Jr. which shows a lock-out enclosure for power connectors.

5,055,057 to Boyer which shows an electric plug lock.

5,061,194 to Herman et al. which shows an electrical connector lockout device.

SUMMARY OF THE INVENTION

In the illustrated embodiment of the present invention a container is provided for receiving at least a portion of an electrical cord and attached plug. The container is adapted to permit the placement of the electrical plug in, or the removal of the electrical plug from, the interior storage volume of the container.

The container is also adapted to receive a portion of the cord extending through the storage volume of the container. The cover and/or the container define at least two slots in communication with the storage volume of the container to receive a portion of the cord within the storage volume and to permit the cord to extend out of the storage volume at each end of the container.

In the illustrated embodiment, the cover is adapted to be positioned in an open or closed position relative to the container. In addition, locking means is included to lock the cover in the closed position on the container.

This apparatus permits a distal portion of the cord and attached plug to be located within the storage volume and another portion of the cord to be located within one of the slots while the cover is in a closed and locked position. In addition, the cover can be unlocked and opened to allow the cord and attached plug to be removed from the storage volume.

It is an object of the present invention to provide an electrical cord protection device that is simple in construction, economical to manufacture and simple and efficient to use.

Another object of the invention is to provide an improved protection apparatus for electrical cords.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
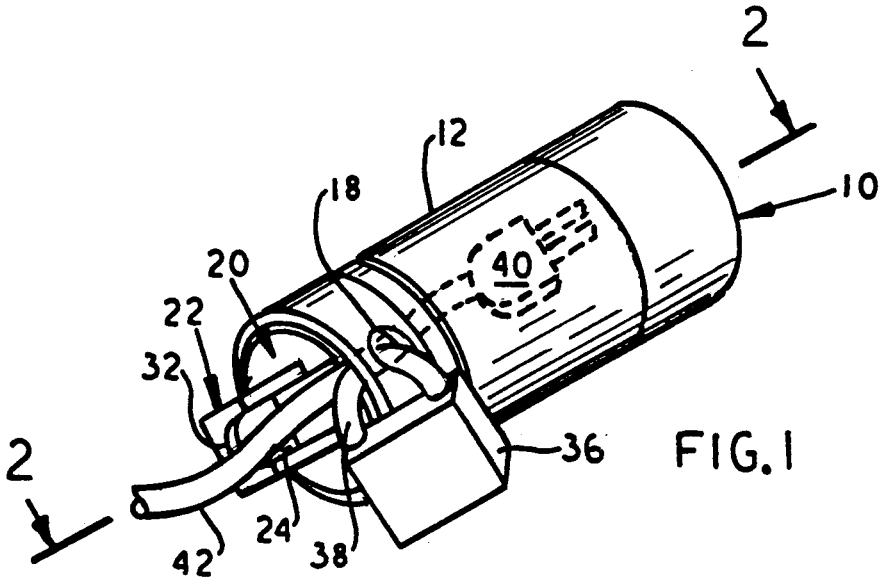
FIG. 1 is an isometric view of the device according to the invention.
Figure 2:
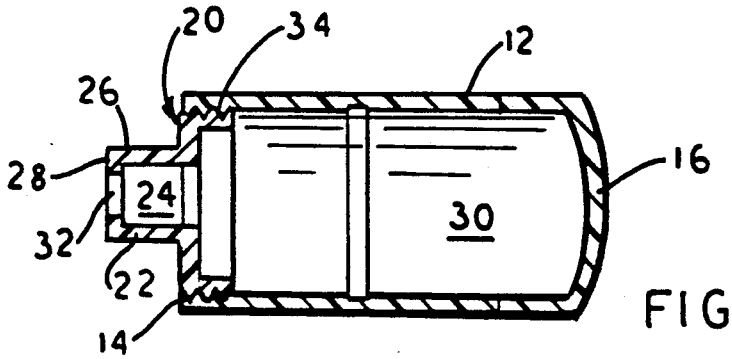
FIG. 2 is a cross sectional view of the body taken on line 2—2 of FIG. 1.

Now with more particular reference to the drawings, shown in the embodiment of FIGS. 1 and 2, appliance safety lock 10 has hollow, generally cylindrical body 12. Body 12 has internally threaded open end 14, closed end 16 and hole 18 adjacent open end 14. Open end 14 may be closed by removable closure 20.

Closure 20 has neck 22 with cavity 24, sides 26 and closed end 28. Cavity 24 communicates with space 3o in body 12. Slot 32 is formed in closure 20 and extends from approximately the center of closure zo and terminates at externally threaded periphery 34 of closure 20.

Padlock 36, a fastening means for closure 20, has hasp 38 and is secured by passing hasp 38 through hole 18 of body 12 and through slot 32 in closure 20.

Plug 40 has electric cord 42 attached thereto extending through slot 32 in closure 20.

Figure 3:
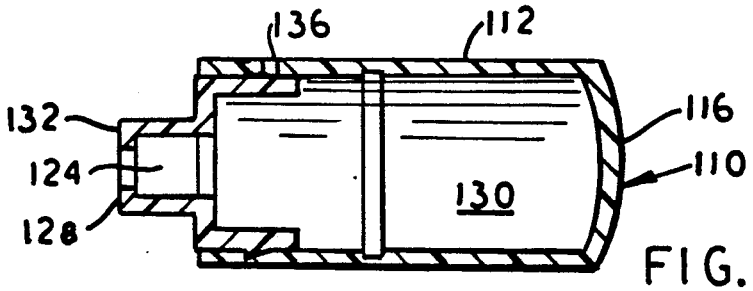
FIG. 3 is a cross sectional view, similar to FIG. 1 of another embodiment of the invention.
Figure 4:
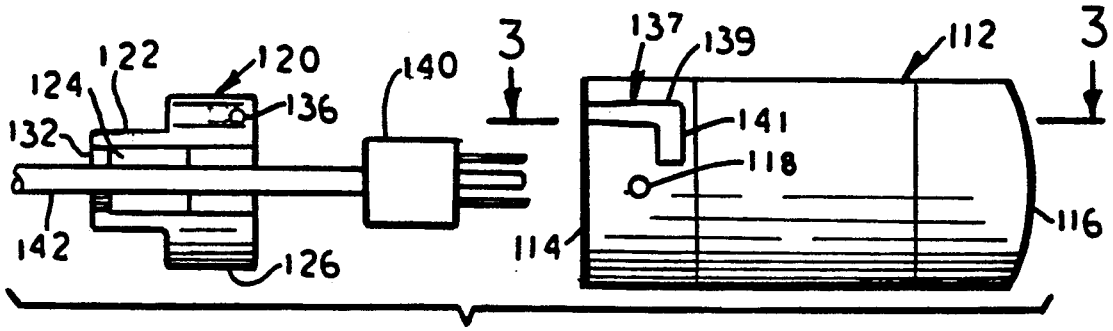
FIG. 4 is an exploded view of the parts of the device according to the invention.

In the embodiment of the invention shown in FIGS. 3 and 4, appliance safety lock 110 has hollow, generally cylindrical body 112. Body 112 has open end 114, closed end 116 and hole 118 adjacent open end 114. Closure 120 has neck 122 with cavity 124, sides 126 and closed end 128. Cavity 124 communicates with space 130 in body 112. Slot 132 is formed in closure 120.

The fastening means is shown in the form of pin 136 adapted to be received in key hole slot 137 in open end 114. Key hole slot 137 has axial part 139 and circumferential part 141.

To use appliance safety lock 110, closure 120 can be removed with plug 140 extending through slot 132. A padlock may then be placed in slot 132 in neck 122 and then placed through hole 118 in body 112 to hold closure 120 against rotation.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An electrical plug lock comprising a generally hollow body and a closure;

said body comprising an open end and a closed end;

a hole in said body adjacent said open end;

said closure being shaped to fit said open end;

a fastening means supporting said closure on said body;

a slot in said closure;

said body being adapted to receive an electrical plug;

said plug having an electric cord attached thereto with said cord extending through said slot and said plug disposed in said body;

a padlock having a hasp adapted to extend through said slot and through said hole whereby said closure is held against rotation.

2. The lock recited in claim 1 wherein said fastening means comprises an internally threaded open end on said body adapted to receive a thread on said closure.

3. The lock recited in claim 1 wherein said fastening means comprises a key hole shaped slot in said body adapted to receive a pin on said closure whereby said closure can be released by rotating said closure a first amount, then withdrawing said pin and said pin adapted to be aligned with an open end of said key hole slot.

4. The lock recited in claim 1 wherein said closure is a generally disk shaped having a hollow neck attached to one end thereof;

said neck having a cavity, sides and a closed end; and, said slot extending through said closed end and one of said sides of said neck.

5. The lock recited in claim 4 wherein said closure has a relatively flat part and a generally cylindrical rim;

said generally cylindrical rim adapted to be received in said open end of said body.

6. The lock recited in claim 5 wherein said fastening means comprises threads on said open end of said body and threads on said rim.

7. The lock recited in claim 5 wherein said fastening means comprises a pin on said rim and a key hole slot in said body for receiving said pin.

* * * * *